US008516653B2

(12) United States Patent
Cunningham et al.

(10) Patent No.: US 8,516,653 B2
(45) Date of Patent: Aug. 27, 2013

(54) CLEANER HANDLE AND CLEANER HANDLE HOUSING SECTIONS

(75) Inventors: J. Vern Cunningham, Aurora (CA); Paul Charlebois, Toronto (CA); Tasneem Babul Rayani, Waterloo (AU); Paul Arato, Toronto (CA)

(73) Assignee: Cube Investments Limited, Aurora (CA)

( * ) Notice: Subject to any disclaimer, the term of this patent is extended or adjusted under 35 U.S.C. 154(b) by 1510 days.

(21) Appl. No.: 11/662,495

(22) PCT Filed: Sep. 16, 2005

(86) PCT No.: PCT/CA2005/001420

§ 371 (c)(1),
(2), (4) Date: Mar. 15, 2007

(87) PCT Pub. No.: WO2006/029535

PCT Pub. Date: Mar. 23, 2006

(65) Prior Publication Data

US 2008/0301903 A1 Dec. 11, 2008

Related U.S. Application Data

(60) Provisional application No. 60/610,557, filed on Sep. 17, 2004.

(51) Int. Cl.
*A47L 9/32* (2006.01)

(52) U.S. Cl.
USPC ..... 15/339; 15/410

(58) Field of Classification Search
USPC ..... 15/339, 377, 319, 324, 314, 301, 15/410
See application file for complete search history.

(56) References Cited

U.S. PATENT DOCUMENTS 1,601,531 A 9/1926 Jeannin
1,883,288 A 10/1932 Zubaty (Continued)

FOREIGN PATENT DOCUMENTS

EP 0192469 8/1986
EP 0347223 12/1989

(Continued)

OTHER PUBLICATIONS

Japan Patent Office, English translation of abstract only of publication No. JP02152419, Floor Nozzle for Vacuum Cleaner, publication date Jun. 12, 1990.

(Continued)

*Primary Examiner* — Robert Scruggs

(57) ABSTRACT

Handle has status indicators viewable by operator while viewing location being cleaned and using handle in ordinary cleaning position, and light illuminating location being cleaned. Indicators are LED lamps. Light is an LED lamp. Microphone senses particles and illuminates an indicator. Indicators and light are provided in a housing section that forms part of a housing for handle. Housing section may be integrated with the remainder of the housing, or may be unit that fits into remainder of housing. Light has central axis generally parallel, within approximately five degrees from parallel, with cleaning axis of handle. Indicators each have a central axis generally parallel, within approximately 5 degrees from parallel, with cleaning axis of handle. The indicators have limited beam angle. Indicator viewable over grasping section of handle from towards distal end of handle. The cleaner may be a vacuum cleaner, which may be a central vacuum cleaner.

35 Claims, 15 Drawing Sheets

(56) References Cited

U.S. PATENT DOCUMENTS 3,088,484 A 5/1963 Marsh
3,357,039 A 12/1967 Hayward
3,382,524 A 5/1968 Sandstrom
3,477,689 A 11/1969 Berghoefer
3,483,503 A 12/1969 Pardiso
3,565,103 A 2/1971 Maselek
3,570,809 A 3/1971 Stuy
3,626,545 A 12/1971 Sparrow
3,628,769 A 12/1971 Lee
3,661,356 A 5/1972 Tucker
3,663,845 A 5/1972 Apstein
3,676,986 A 7/1972 Reiling
3,826,464 A 7/1974 Berghofer
3,855,665 A 12/1974 Schwartz
3,965,526 A 6/1976 Doubleday
3,989,311 A * 11/1976 Debrey ..... 406/36
4,056,334 A 11/1977 Fortune
4,070,586 A 1/1978 Breslin
4,111,615 A 9/1978 Watanabe
4,114,557 A 9/1978 De Brey
4,175,892 A 11/1979 De Brey
4,225,272 A 9/1980 Palmovist
4,227,258 A 10/1980 Root et al.
4,246,675 A 1/1981 Costanzo
4,300,262 A 11/1981 Rodowsky, Jr. et al.
4,336,427 A 6/1982 Lindsay
4,368,348 A 1/1983 Eichelberger et al.
4,369,543 A 1/1983 Chen et al.
4,370,776 A 2/1983 Kullik
4,443,906 A 4/1984 Tucker et al.
4,473,923 A 10/1984 Neroni et al.
4,490,575 A 12/1984 Kutnyak
4,494,270 A 1/1985 Ritzau et al.
4,513,469 A 4/1985 Godfrey et al.
4,531,796 A 7/1985 Gansert et al.
4,536,674 A 8/1985 Schmidt
4,591,368 A 5/1986 MacDuff
4,611,365 A 9/1986 Komatsu et al.
4,654,924 A 4/1987 Getz et al.
4,664,457 A 5/1987 Suchy
4,680,827 A 7/1987 Hummel
4,683,515 A 7/1987 Beihoff et al.
4,688,596 A 8/1987 Liebmann et al.
4,693,324 A 9/1987 Choiniere et al.
4,731,545 A 3/1988 Lerner et al.
4,757,574 A 7/1988 Sumerau
4,766,628 A 8/1988 Walker
4,791,700 A 12/1988 Bigley et al.
4,829,625 A * 5/1989 Wang ..... 15/422.2
4,829,626 A 5/1989 Harkonen et al.
4,854,887 A 8/1989 Blandin
4,881,909 A 11/1989 Blackman
4,883,982 A 11/1989 Forbes et al.
D315,043 S 2/1991 Hayden
4,991,253 A 2/1991 Rechsteiner
5,033,151 A 7/1991 Kraft et al.
5,067,394 A 11/1991 Cavallero
5,068,555 A 11/1991 Oberdorfer-Bogel
5,107,565 A 4/1992 Chun
5,109,568 A 5/1992 Rohn et al.
5,111,841 A 5/1992 Houston
5,120,983 A 6/1992 Samann
5,125,125 A 6/1992 Barsacq
D333,023 S 2/1993 Herron, Jr.
5,185,705 A 2/1993 Farrington
D334,447 S 3/1993 Rohn
5,191,673 A 3/1993 Damizet
5,207,498 A 5/1993 Lawrence et al.
5,244,409 A 9/1993 Guss et al.
5,255,409 A 10/1993 Fujiwara et al.
5,263,502 A 11/1993 Dick
5,265,305 A * 11/1993 Kraft et al. ..... 15/319
5,274,578 A 12/1993 Noeth
5,274,878 A * 1/1994 Radabaugh et al. ..... 15/314
5,276,434 A 1/1994 Brooks et al.
5,276,939 A 1/1994 Uenishi
5,277,468 A 1/1994 Blatt et al.
5,298,821 A 3/1994 Michel
5,301,385 A 4/1994 Abe et al.
5,311,639 A 5/1994 Boshier
5,343,590 A 9/1994 Radabaugh
5,347,186 A 9/1994 Konotchick
5,349,146 A 9/1994 Radabaugh
5,353,468 A 10/1994 Yap et al.
5,363,534 A 11/1994 Dekker et al.
5,379,796 A 1/1995 Wang
5,391,064 A 2/1995 Lopez
5,404,612 A 4/1995 Ishikawa
5,409,398 A 4/1995 Chadbourne et al.
5,448,827 A 9/1995 Ward
D364,014 S 11/1995 Langeland et al.
5,479,676 A 1/1996 Martin et al.
5,504,971 A 4/1996 McCormick
5,512,883 A 4/1996 Lane, Jr.
5,515,572 A 5/1996 Hoekstra et al.
5,525,842 A 6/1996 Leininger
5,542,146 A 8/1996 Hoekstra et al.
5,554,049 A 9/1996 Reynolds
5,560,076 A 10/1996 Leung
5,568,374 A 10/1996 Lindeboom et al.
5,572,767 A 11/1996 Ishikawa
5,578,795 A 11/1996 Ward
5,606,767 A 3/1997 Crienjak
5,655,884 A 8/1997 Rose
5,698,957 A 12/1997 Sowada
5,713,656 A 2/1998 Lin
5,722,110 A 3/1998 McIntyre et al.
5,737,797 A 4/1998 Rittmueller et al.
5,737,798 A 4/1998 Moren et al.
5,740,581 A 4/1998 Harrelson, II
5,740,582 A 4/1998 Harrelson, II
5,747,973 A 5/1998 Robitaille et al.
5,753,989 A 5/1998 Syverson et al.
5,813,085 A 9/1998 Fritz et al.
5,815,883 A 10/1998 Stein et al.
5,815,884 A * 10/1998 Imamura et al. ..... 15/339
5,816,685 A 10/1998 Hou
5,850,665 A 12/1998 Bousset
5,871,152 A 2/1999 Saney
D406,422 S 3/1999 Burchard et al.
5,896,618 A 4/1999 Woo et al.
5,917,428 A 6/1999 Discenzo et al.
5,918,728 A 7/1999 Syverson
5,924,163 A 7/1999 Burns, Jr.
5,924,164 A 7/1999 Lindsay, Jr.
5,926,908 A 7/1999 Lindsay, Jr.
5,926,909 A 7/1999 McGee
5,938,061 A 8/1999 Ward et al.
5,945,749 A 8/1999 Li
5,983,443 A 11/1999 Redding
5,987,697 A 11/1999 Song et al.
6,029,309 A 2/2000 Imamura
6,033,082 A 3/2000 Lin
6,049,143 A 4/2000 Simpson et al.
6,101,667 A 8/2000 Ishikawa
D431,335 S 9/2000 Mehaffey et al.
6,169,258 B1 1/2001 Roney et al.
6,206,181 B1 3/2001 Syverson
6,218,798 B1 4/2001 Price et al.
6,232,696 B1 5/2001 Kim et al.
6,239,576 B1 5/2001 Breslin et al.
6,244,427 B1 6/2001 Syverson
6,253,414 B1 7/2001 Bradd et al.
6,256,833 B1 7/2001 Steinberg
6,323,570 B1 11/2001 Nishimura et al.
6,336,825 B1 1/2002 Seefried
6,425,293 B1 7/2002 Woodroffe et al.
6,459,056 B1 10/2002 Graham
6,463,368 B1 10/2002 Feiten et al.
6,488,475 B2 12/2002 Murata et al.
6,546,814 B1 4/2003 Choe et al.
6,628,019 B2 9/2003 Carroll
6,658,325 B2 12/2003 Zweig
6,685,491 B2 2/2004 Gergek

| | | | | |
|---|---|---|---|---|
| 6,690,804 | B2 | 2/2004 | Everett | |
| D494,332 | S | 8/2004 | Schroeter | |
| D494,333 | S | 8/2004 | Schroeter | |
| 6,779,228 | B2 | 8/2004 | Plomteux et al. | |
| 6,791,205 | B2 | 9/2004 | Woodbridge | |
| 6,817,058 | B1 | 11/2004 | Harrelson, II | |
| 6,822,353 | B2 | 11/2004 | Koga et al. | |
| 6,864,594 | B2 | 3/2005 | Seki | |
| 6,900,565 | B2 | 5/2005 | Preston | |
| 6,975,043 | B2 | 12/2005 | Schumacher et al. | |
| 6,975,993 | B1 | 12/2005 | Lin | |
| 7,051,398 | B2 | 5/2006 | Smith et al. | |
| 7,080,425 | B2 | 7/2006 | Smith et al. | |
| 7,114,216 | B2 | 10/2006 | Stephens et al. | |
| 7,122,921 | B2 | 10/2006 | Hall et al. | |
| 7,237,298 | B2 | 7/2007 | Reindle et al. | |
| 7,269,877 | B2 | 9/2007 | Tondra et al. | |
| 7,328,479 | B2 | 2/2008 | Willenbring | |
| 7,331,083 | B2 | 2/2008 | Overvaag et al. | |
| 7,342,372 | B2 | 3/2008 | Jonsson et al. | |
| 7,363,679 | B2 | 4/2008 | Zimmerle et al. | |
| 7,403,360 | B2 | 7/2008 | Cunningham et al. | |
| 7,406,744 | B2 | 8/2008 | Bruneau | |
| 2002/0001190 | A1 | 1/2002 | Everett | |
| 2002/0127916 | A1 | 9/2002 | Zhang | |
| 2002/0152576 | A1 | 10/2002 | Murray et al. | |
| 2003/0044243 | A1 | 3/2003 | Tisdale | |
| 2003/0140443 | A1 | 7/2003 | Najm | |
| 2003/0196293 | A1 | 10/2003 | Ruff | |
| 2004/0031506 | A1* | 2/2004 | Tsai | 134/105 |
| 2004/0049868 | A1 | 3/2004 | Ng | |
| 2004/0144633 | A1* | 7/2004 | Gordon et al. | 200/308 |
| 2004/0150271 | A1 | 8/2004 | Koga et al. | |
| 2004/0172782 | A1 | 9/2004 | Smith et al. | |
| 2004/0177468 | A1 | 9/2004 | Smith et al. | |
| 2004/0231090 | A1 | 11/2004 | Kushida et al. | |
| 2004/0261211 | A1 | 12/2004 | Overvaag et al. | |
| 2005/0022329 | A1 | 2/2005 | Harman et al. | |
| 2005/0022337 | A1 | 2/2005 | Roney et al. | |
| 2005/0166351 | A1 | 8/2005 | Cunningham et al. | |
| 2005/0236012 | A1 | 10/2005 | Josefsson et al. | |
| 2005/0245194 | A1 | 11/2005 | Hayes et al. | |
| 2005/0254185 | A1 | 11/2005 | Cunningham | |
| 2007/0017057 | A1 | 1/2007 | Zimmerle et al. | |
| 2007/0283521 | A1 | 12/2007 | Foster et al. | |
| 2008/0066252 | A1 | 3/2008 | Herron, Jr. | |
| 2008/0222836 | A1 | 9/2008 | Cunningham | |
| 2008/0301903 | A1 | 12/2008 | Cunningham et al. | |

FOREIGN PATENT DOCUMENTS

| | | |
|---|---|---|
| EP | 0552978 | 7/1993 |
| EP | 0499235 | 9/1995 |
| EP | 0711023 | 5/1996 |
| EP | 0773619 | 5/1997 |
| GB | 2281507 | 3/1995 |
| GB | 2288115 | 10/1995 |
| JP | 53-58160 | 5/1978 |
| JP | 53-128158 | 11/1978 |
| JP | 60-26494 | 9/1985 |
| JP | 64-049526 | 2/1989 |
| JP | 2-152420 | 6/1990 |
| JP | 5-003839 | 1/1993 |
| JP | 5-317213 | 3/1993 |
| JP | 6-277167 | 10/1994 |
| JP | 7-095944 | 11/1995 |
| JP | 7-322980 | 12/1995 |
| JP | 8-033596 | 2/1996 |
| JP | 8-117165 | 5/1996 |
| JP | 8-065876 | 8/1996 |
| JP | 8-240329 | 9/1996 |
| JP | 9-149871 | 10/1997 |
| JP | 10-094504 | 4/1998 |
| JP | 2000-116577 | 4/2000 |
| JP | 2001-137158 | 5/2001 |
| JP | 2002-078656 | 3/2002 |
| JP | 2002-320577 | 5/2002 |
| JP | 2003-235767 | 8/2003 |
| JP | 2005-102465 | 4/2005 |
| JP | 2009-058919 | 3/2009 |
| WO | 97/37423 | 10/1997 |
| WO | 97/41631 | 11/1997 |
| WO | 98/35160 | 8/1998 |
| WO | WO 99/09875 | 3/1999 |
| WO | 99/56606 | 11/1999 |
| WO | WO 00/64323 | 11/2000 |
| WO | 2005/031169 | 4/2005 |

OTHER PUBLICATIONS

Japan Patent Office, English translation of abstract only of publication No. JP04017830, Vacuum Cleaner, publication date Jan. 22, 1992.

Japan Patent Office, English translation of abstract only of publication No. JP04017831, Vacuum Cleaner, publication date Jan. 22, 1992.

Extended European Search Report for EP 05788490.0 , dated Jul. 13, 2009.

Audioetcetera, Wireless Remote Control for Filtex Vacuum Systems, http://www.audio-etcetera.com/prod.itml/icOid/135540.

Central Vacuum Systems Owners Guide, M&S Systems.

Heritage Central Vacuum, Crush Proof Hoses Non-Electric, http://www.heritagevac.com/hosesnonelectric.html, printed Sep. 21, 2005, pp. 4, Azusa, USA.

International Search Report for PCT/CA2005/001420 dated Jan. 6, 2006.

International Search Report of PCT/CA2006/001436 dated Dec. 27, 2006.

International Preliminary Report on Patentability & Written Opinion of the International Search Authority from PCT/CA2005/001420 dated Jan. 9, 2007.

New Central Vacuum Breaks Home Automation Barrier, Business Wire dated Feb. 26, 2002.

The Eureka Company, Cordless, Rechargeable Vacuum Cleaner, Household Type, Owner's Guide, Model 570, 2000, pp. 12, Bloomington, USA.

The Eureka Company, Cordless, Rechargeable Vacuum Cleaner, Household Type, Owner's Guide, Model 96B, 2001, pp. 12, Bloomington, USA.

Ultimate Air Inc., The UltimateAir RecoupAerator 200DX Energy Recovery Ventilator, Owner's Manual and Installation Guide, Jan. 24, 2006, pp. i-iv, 1-41Athens, USA.

* cited by examiner

CLEANER HANDLE AND CLEANER HANDLE HOUSING SECTIONS

CROSS-REFERENCE TO RELATED APPLICATIONS

This application claims priority from, and the benefit of, the filing date of U.S. Patent Application No. 60/610,557 filed 17 Sep. 2004 under title Cleaner Handle And Cleaner Handle Housing Sections. The contents of the above application is hereby incorporated by reference into the MODE(S) FOR CARRYING OUT THE INVENTION herein.

TECHNICAL FIELD

The invention relates to cleaner handles, and to housing sections therefor.

BACKGROUND ART

Cleaners include vacuum cleaners, floor cleaners, and the like. Vacuum cleaners include all types of vacuum cleaners, such as, for example, central vacuum cleaners, canister vacuum cleaners and upright vacuum cleaners.

Makers of cleaners have been adding features to their cleaners in order to remain competitive. For example, illuminated indicators have been used for many years to provide information about the status of the cleaner to an operator. The indicators may provide information such as whether or not the cleaner is ON. These indicators are helpful for all cleaners. They are particularly helpful in cleaners that have components remote from a handle that an operator of the cleaner grasps while vacuuming, such as in a central vacuum cleaner.

The indicators have been placed on the handle itself. Originally these indicators used incandescent bulbs that emitted from a top surface of the handle. More recently, the indicators use LED lamps emitting from a top surface of the handle.

Lights have also been used on powered attachments at floor level to illuminate in front of the attachment while cleaning. Also, microphones have been used to sense dust particles moving through a cleaner.

Improvements or alternatives to currently available features for cleaners are desirable.

DISCLOSURE OF THE INVENTION

In a first aspect the invention provides a cleaner handle for use on a cleaner. The handle has a grasping section for manipulating the cleaner, an indicator housing, and at least one indicator within the indicator housing. The indicator has a limited viewing angle and a central axis. The central axis is directed over and across the grasping section such that the indicator is within the view of an operator holding the grasping section in an ordinary vacuuming position.

The cleaner may be a vacuum cleaner. The cleaner may be a central vacuum cleaner. The cleaner may be a canister vacuum cleaner. The cleaner may be an upright vacuum cleaner.

The indicator may be an LED lamp. The indicator may be an LCD display. The central axis of the indicator may be generally parallel with a cleaning axis of the handle, the cleaning axis being a line from the handle to a location currently being cleaned by the cleaner. The central axis of the indicator may be directed approximately 5 degrees vertically above a cleaning axis of the handle, the cleaning axis being a line from the handle to a location currently being cleaned by the cleaner.

The handle may also have an illuminator housing, a light within the illuminator housing, the light for illuminating with visible light an area that is being cleaned with the cleaner. A central beam axis of the light may be generally parallel with a cleaning axis of the handle, the cleaning axis being a line from the handle to a location currently being cleaned by the cleaner. A central beam axis of the light may be directed within approximately 5 degrees vertically of a cleaning axis of the handle, the cleaning axis being a line from the handle to a location currently being cleaned by the cleaner.

The handle may have a distal end for receiving particles from a location being cleaned. The indicator may be located between the distal end and the grasping section. The handle may have an indicator housing section that houses the indicator. The indicator housing section may have an aperture with the indicator viewable through the aperture. The aperture may be raised such that the indicator is viewable over a hand of an operator that is grasping the grasping section.

The handle may have a particle sensor for sensing particles flowing through the handle during operation of the cleaner. The particle sensor may have a microphone for sensing sound emitted when particles collide with a conduit in the handle as the particles flow through the cleaner. The conduit may be made from metal. The microphone may be held against the conduit by a spring mechanism. The spring mechanism may be a biased curved plastic strip.

The indicator may be within the view of the operator when the operator is viewing a location being cleaned by the cleaner.

In a further aspect the invention provides a cleaner handle for use on a cleaner. The handle includes a grasping section for manipulating the cleaner, an indicator housing, and at least one indicator within the indicator housing, the indicator having a limited viewing angle and a central axis. The central axis is directed over and across the grasping section such that the indicator is within the view of an operator holding the grasping section and viewing a location being cleaned by the cleaner.

The view of the operator includes a line to the location that is generally parallel to a cleaning axis of the handle, the cleaning axis being a line between the handle and the location being cleaned.

The central beam axis of the indicator may be directed at least 5 degrees vertically above a cleaning axis of the handle, the cleaning axis being a line from the handle to a location currently being cleaned by the cleaner.

The indicator beam angle may be approximately 20°. The light may be one or more LED lamps. The beam angle of each LED lamp may be approximately 12°.

In a still further aspect the invention provides a cleaner handle section for attachment to a housing of a cleaner handle having a grasping section for manipulating the cleaner. The cleaner handle section includes an indicator housing section, and at least one indicator within the indicator housing section, the indicator having a limited viewing angle and a central axis. The central axis is directed over and across the grasping section such that the indicator is within the view of an operator holding the grasping section and viewing a location being cleaned by the cleaner.

In another aspect the invention provides a cleaner handle for use on a cleaner. The handle includes a grasping section for manipulating the cleaner, an indicator housing, and at least one indicator within the indicator housing. The indicator has a lamp for emitting a visible beam of light from the indicator housing with a limited beam angle and a central beam axis. The central beam axis is directed over and across the grasping section such that the beam is within the view of an operator holding the grasping section in an ordinary vacuuming position.

The indicator housing section may have an aperture and the beam of light may emit from the aperture. The aperture may be raised such that the indicator beam of light emits over a hand of an operator that is grasping the grasping section. The beam may be within the view of the operator when the operator is viewing a location being cleaned by the cleaner.

In yet another aspect the invention provides a cleaner handle for use on a cleaner. The handle includes a grasping section for manipulating the cleaner, an indicator housing, and at least one indicator within the indicator housing. The indicator has a lamp for emitting a visible beam of light from the indicator housing with a limited beam angle and a central beam axis. The central beam axis is directed over and across the grasping section such that the beam is within the view of an operator holding the grasping section and viewing a location being cleaned by the cleaner.

In still another aspect the invention provides a cleaner handle section for attachment to a housing of a cleaner handle having a grasping section for manipulating the cleaner. The cleaner handle section includes an indicator housing section and at least one indicator within the indicator housing section, the indicator including a lamp for emitting a visible beam of light from the indicator housing with a limited beam angle and a central beam axis. The central beam axis is directed over and across the grasping section such that the beam is within the view of an operator holding the grasping section and viewing a location being cleaned by the cleaner.

Other aspects of the invention are evident from the Mode(s) For Carrying Out The Invention herein.

BRIEF DESCRIPTION OF THE DRAWINGS

For a better understanding of the present invention and to show more clearly how it may be carried into effect, reference will now be made, by way of example, to the accompanying drawings which show the preferred embodiment of the present invention and in which.

MODE(S) FOR CARRYING OUT THE INVENTION

Figure 1:
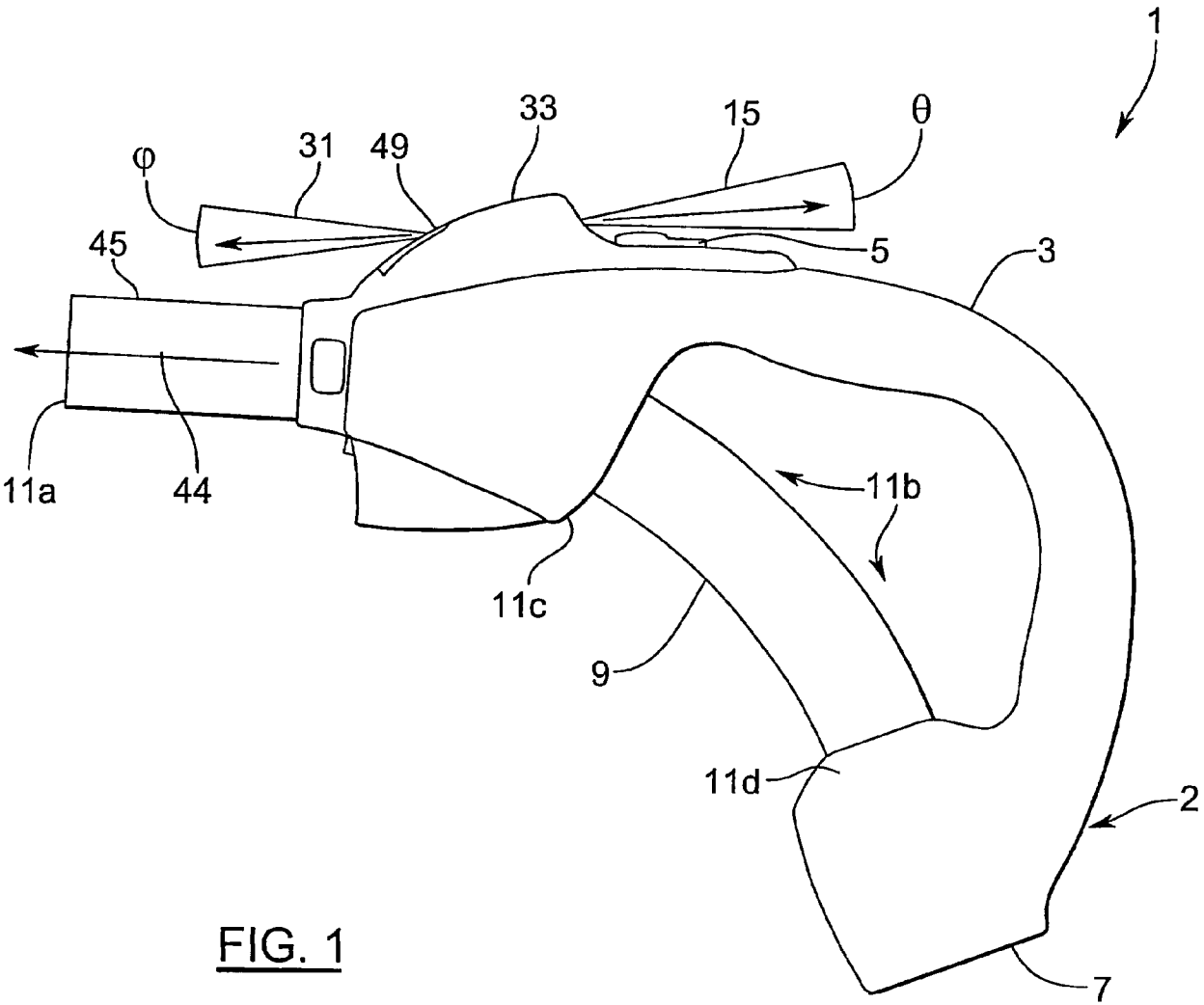
FIG. 1 is a side view of a handle in accordance with a preferred embodiment of the present invention.

Referring to FIGS. 1 through 7, a cleaner handle 1 has a housing 2 with a grasping section 3, a control input 5 (a two-way button switch is shown for the control input 5 in the FIGS.), and a hose receiver 7. The handle 1 also has a generally tubular conduit 9. The hose receiver 7 receives a vacuum hose 10 and provides fluid connection from the hose 10 to the conduit 9. The conduit 9 has a distal end 11*a* that is open to draw in particles through the conduit 9 for transfer to the hose 10. The vacuum hose 10 may be connected to a wall outlet 12*a* in the case of a central vacuum cleaning system 12*b*, or to a vacuum canister in the case of a canister vacuum (see for example FIG. 15). The grasping section 3 is connected to the conduit 9 to allow a user of the vacuum cleaner to grasp the grasping section 3 and manipulate the conduit 9 to vacuum clean a desired location, such as a floor 12*c*.

The conduit 9 is typically separate from the housing 2 and made of metal, such as chromed steel, and, for this reason is sometimes referred to as a "metal wand"; however, the conduit 9 could be made from plastic or another rigid material. Also, the conduit 9 may be integrated with the housing 2. Where the conduit 9 is separate from the remainder of the housing 2, the housing 2 must have a conduit holder 11*b*. In the handle 1, the conduit holder 11*b* is provided in two conduit holder portions 11*c*, 10*d*. The distal end 11*a* of the conduit 9 may receive attachments, such as conduit extensions 12*d* for cleaning locations further away from the handle, carpet sweepers 12*e*, brushes (powered and unpowered), crevices tools, and the like, not shown.

Figure 2:
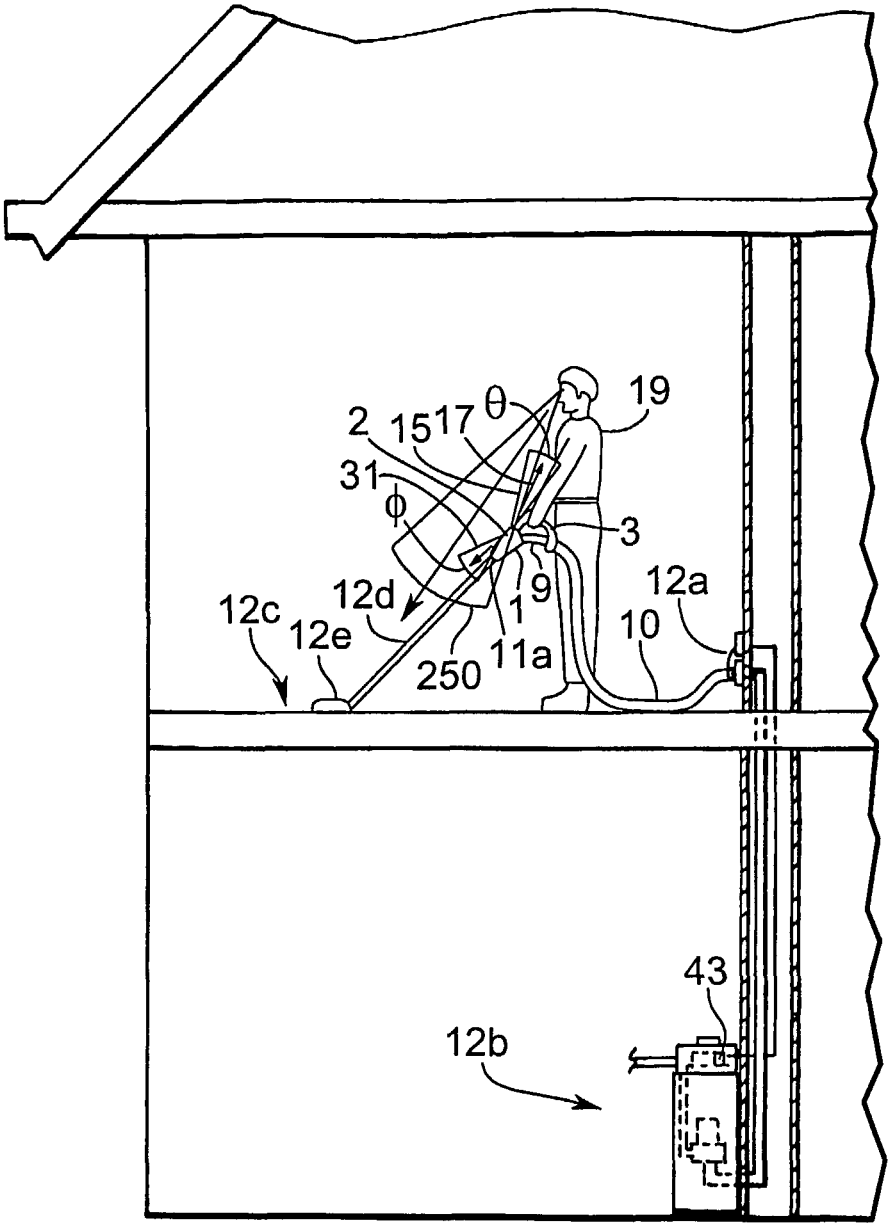
FIG. 2 is a partial cross-section of a building containing a central vacuum cleaner utilizing the handle of FIG. 1.
Figure 3:
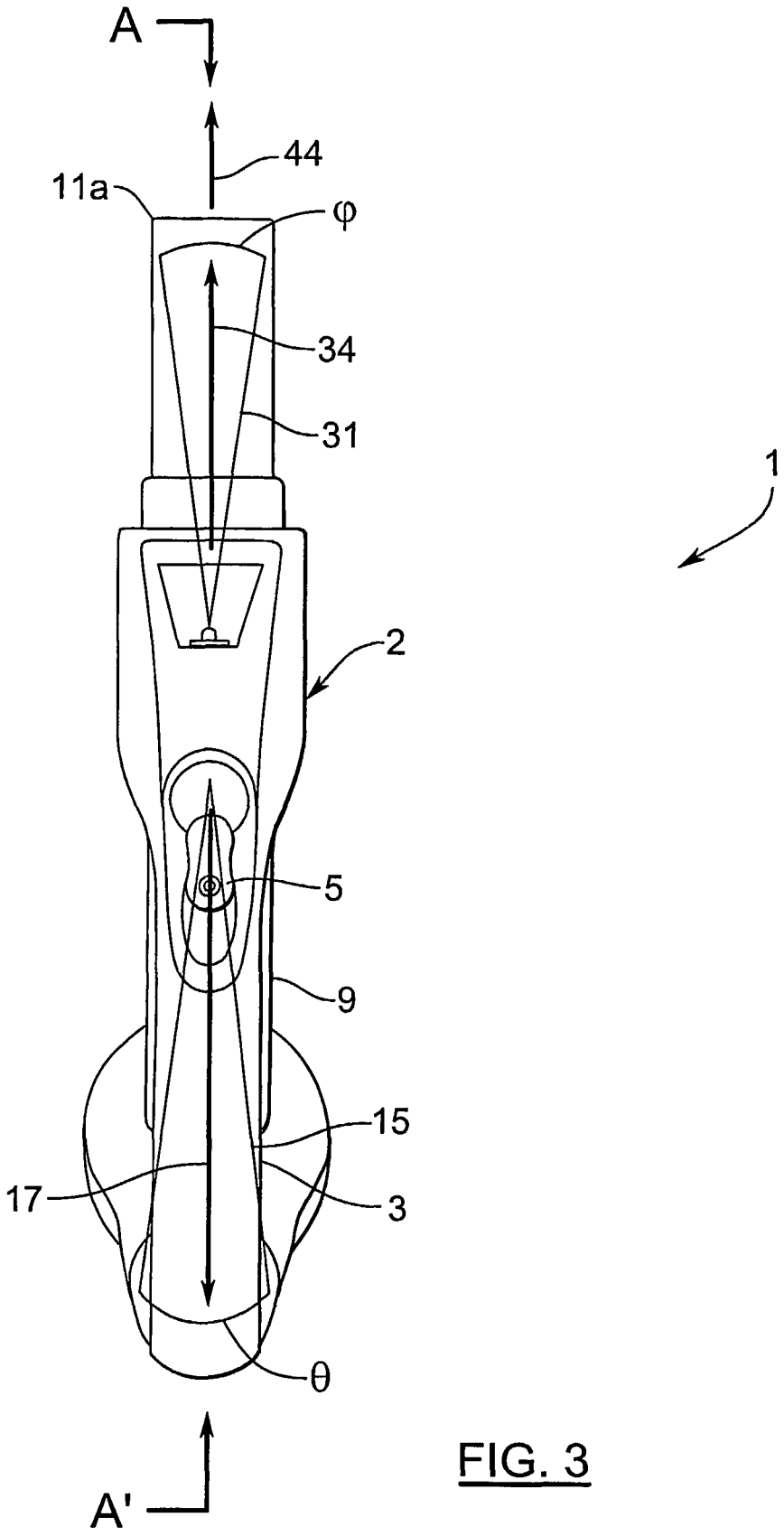
FIG. 3 is a top view of the handle of FIG. 1.
Figure 4:
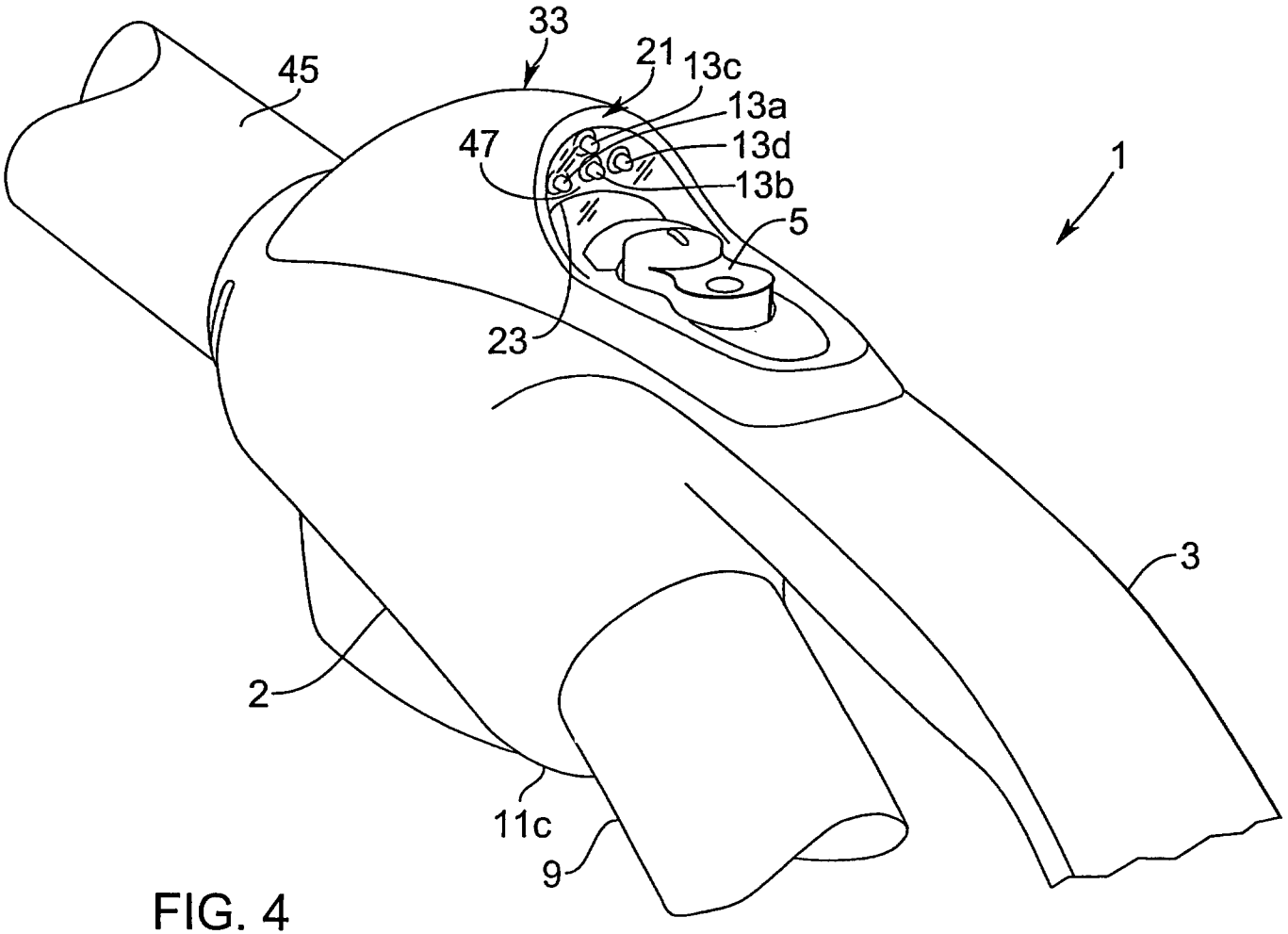
FIG. 4 is a perspective view from above, to the rear and to one side of a portion of the handle of FIG. 1.
Figure 5:
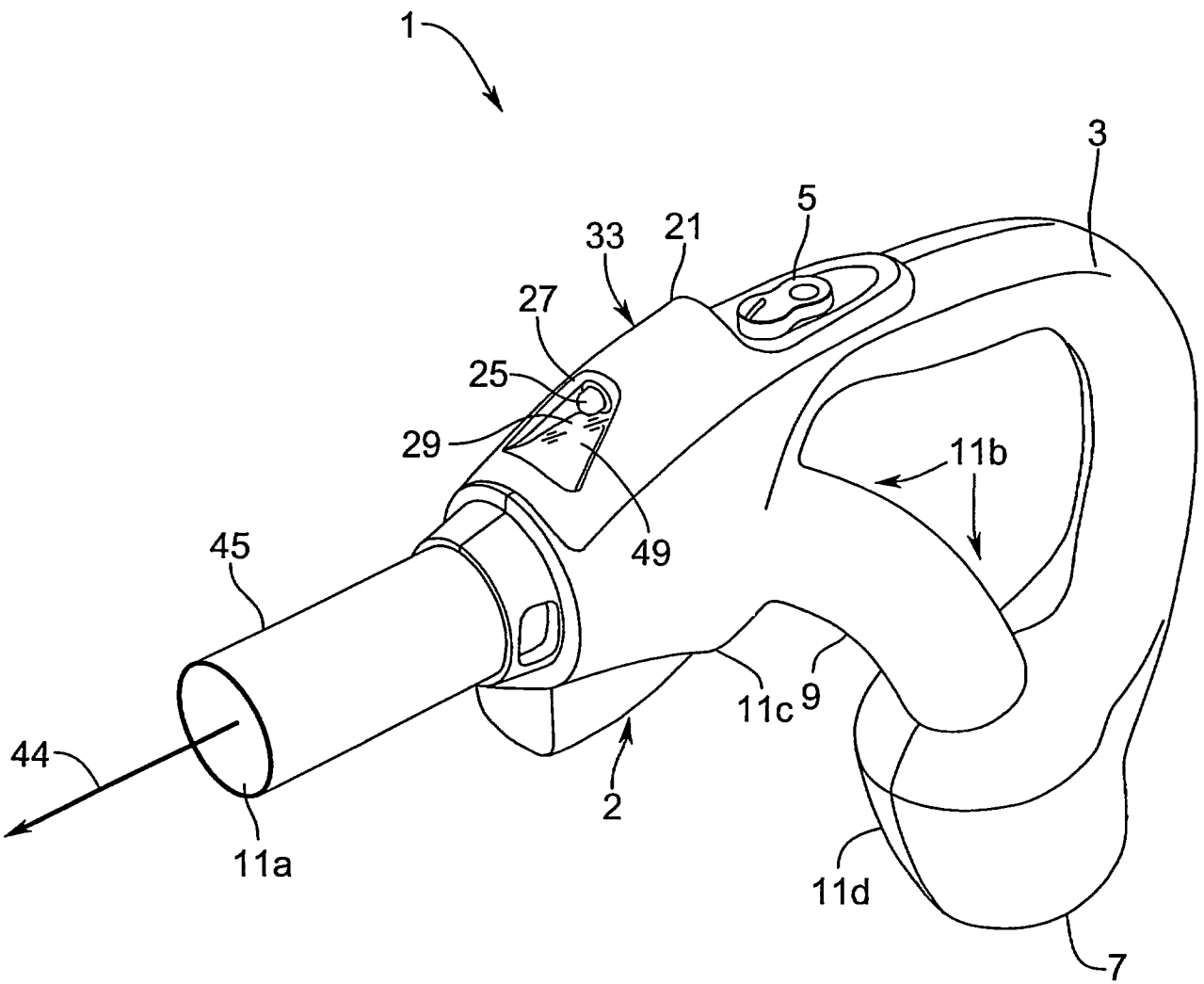
FIG. 5 is a perspective view from above, to the front, and to one side of the handle of FIG. 1.

Between the grasping section 3 and the distal end 11*a*, the handle 1 has indicators 13 (shown individually as 13*a*, 13*b*, 13*c*, 13*d* in the FIGS.). Each indicator 13 is a lamp for emitting a visible beam of light 15 from the housing 2. The beam of light 15 has a limited bandwidth θ and a central beam axis 17. Each beam of light 15 is directed towards an operator 19 when the operator 19 is in an ordinary vacuuming position, such as cleaning a floor when standing as shown in FIG. 2. Each beam 15 is in a view 250 of the operator 19 when the operator 19 is using the handle 1 in an ordinary vacuuming position. The beam 15 is in the view 250 of the operator 19 when the operator 19 is using the handle and viewing a location 12*c* being cleaned. For clarity, in the FIGS. only a beam of light 15 for a single indicator 13 is shown. It is understood that each indicator will have its own beam of light 15.

Preferably, each indicator 13 is an LED lamp. LED lamps have many benefits, any one of which may be desirable to a designer creating a handle in accordance with the principles described herein. LED lamps are relatively inexpensive, small, efficient (drawing little energy when compared to light output), output less heat than most other light sources, and are long lasting. In addition, they are available in many colours, including multi-coloured LED lamps, and can be mounted on a printed circuit board.

In the preferred embodiment there are four indicators 13*a*, 13*b*, 13*c*, 13*d*. Indicators 13*a*, 13*b*, 13*d* are green, while indicator 13*c* is red. Illumination of indicator 13*c* indicates that particles are flowing through the conduit 9. The manner in which this is sensed in the preferred embodiment will be discussed later below. If no particles are sensed flowing through the conduit 9 then indicator 13*c* is off and indicator 13*a* is illuminated. When the cleaner is on, indicator 13*b* is illuminated, and if a power brush is attached and turned on then indicator 13*d* is illuminated. Other colours may be used, such as, for example, readily available amber, yellow or blue LEDs. Greater or fewer indicators 13 may be used. The indicators 13 may be multi-coloured to indicate a plurality of conditions with a single indicator. Also, the indicators 13 may illuminate according to different timing patterns to indicate different conditions.

As a further example, the indicators 13 may be an LCD display of compatible size. An LCD display has many of the advantages of LEDs including relatively low cost and low power draw. An LCD display can be driven to display icons for the indication of different conditions such as those discussed above. The LCD display may be backlit such that the LCD display is an indicator emitting a visible beam of light 15 from the face of the LCD display with a limited beam angle Θ and a central axis 17. If the LCD display is not backlit, then the icons may simply have contrasting shades that are viewable when the LCD is lit by ambient light. In this case, the direction of the LCD display from a central point of the screen (the "central axis") is equivalent to the central beam axis 17. Similarly, the viewing angle of the LCD display will be equivalent to the angle Θ and the area within the viewing angle will be equivalent to the beam of light 15.

The central beam axes 17 are directed from between the distal end 11*a* and the grasping section 3 in the view of an operator 19 using the handle 1 in an ordinary vacuuming position. The central beam axes 17 are directed over and across the grasping section 3 from between the distal end 11*a* and the grasping section 3.

The indicators 13 are in an indicator housing section 21 of the housing 2. The indicator housing section has an aperture 23 through which the beams of light 15 emit from the housing 2. The aperture 23 in the indicator housing section 21 in the handle 1 is raised above the grasping section 3 in order to allow the central beam axes 17 to pass over and across the grasping section 3 without being blocked by the hand of the operator 19, or other components such as, for example, the switch 5.

The handle 1 also has a light 25 for emitting visible light for illuminating a location 12*c* to be cleaned. The light 25 is one or more LED lamps 25 (one lamp 25 is shown in the FIGS.). The LED lamp 25 outputs greater light intensity than the indicator 13, as the lamp 25 is intended to illuminate the location 12*c*. The intensity of the light 25 may be selected to illuminate an area 12*c* that is close to the handle, for example for use when the handle 1 is used without extensions 12*d*. Alternatively, the intensity may be selected to illuminate both a close location 12*c*, and a location that is further from the handle 1 when the handle 1 is used with one or more extensions 12*d*. The light preferably emits white light; however, other wavelengths could be used as desired by a designer of the handle, such as red, green, amber, yellow or blue.

The light 25 is in an illumination housing section 27 of the housing 2 between the grasping section 3 and the distal end 11*a*. The illumination housing section 27 has an aperture 29 through which a beam of light 31 shines toward a location 12*c* to be cleaned. In the handle 1, the illumination housing section 27 is closer to the distal end 11*a* of the handle 1, while the indicator housing section 21 is closer to the grasping section 3; so that, the illumination housing section 27 and the indicator housing section 21 do not block their respective beams of light 15, 31. In the handle 1, the illumination housing section 27 and the indicator housing section 21 are integrated as a single illumination indicator housing section 33.

The beam of light 31 has a limited beam angle Φ and a central beam axis 34. The central beam axis 34 is directed towards the location to be cleaned 12*c*. The beam angle Φ is selected to illuminate a desired amount of the area to be cleaned at a given distance. If the intensity of the light is selected for close work only, then the beam angle Φ could be broader than for illumination of an area 12*c* that is further away. Suitable LED lamps include Lite-on, Inc. of Milpitas, Calif. part no. LTL33BCWK5AT or Kingbrite of City of Industry, Calif. part no. W7524PWC\H. The Kingbrite lamp has a beam angle Φ of approximately 12 degrees and an intensity of approximately 7500 mcd. It is to be recognized that additional optics could be provided to allow the beam angle Φ to be altered when in use.

Figure 6:
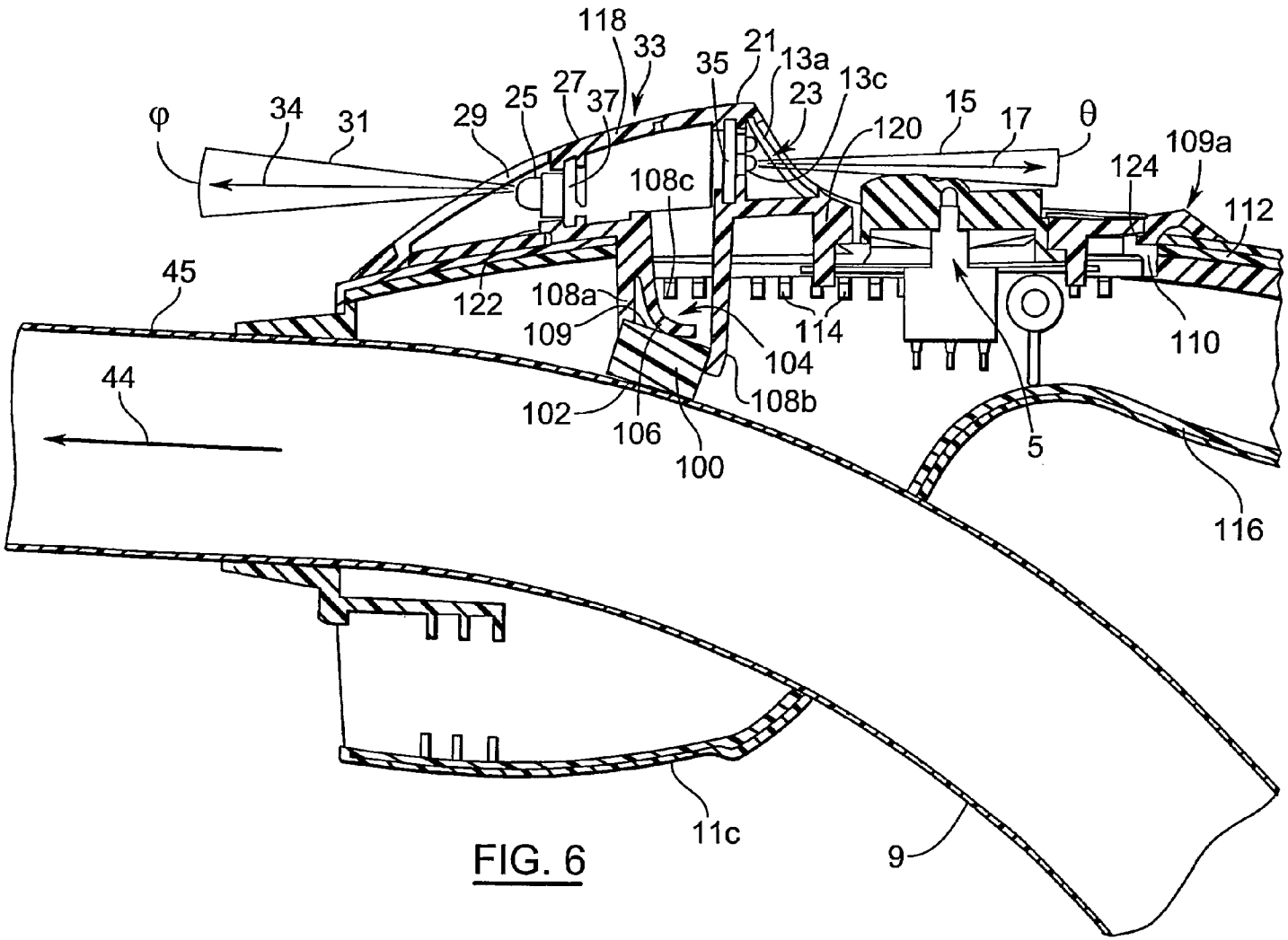
FIG. 6 is a cross-section of a portion of the handle of FIG. 1 along the line A-A' of FIG. 3.

Referring in particular to FIG. 6, the indicators 13 (13*a* and 13*c* are shown in the FIG.) are mounted on a printed circuit board 35, while the light 25 is mounted on a printed circuit board 37. Another printed circuit board, not shown is mounted within the housing 2 with a control circuit, including a microprocessor for controlling operation of the handle 1. For clarity, wiring connections between the various boards 35, 37, the control circuit board and other components within the handle 1, such as hose receiver 7, are not shown. In a wired control application, low voltage wires extend from the handle 1 through the hose receiver 7 and hose 10 to a central vacuum suction unit 43 (FIG. 2), or to a canister vacuum (see for example FIG. 15) or to another vacuum cleaner suction unit, such as a suction motor of an upright vacuum (see for example FIG. 13). Wireless control is also possible, for example, as described in a co-pending United States patent application of J. Vern Cunningham entitled Central Vacuum Cleaning System Control Subsystems filed 9 Sep. 2004, application number not yet known, the content of which is hereby incorporated by reference into the detailed description hereof.

It has been found that it is acceptable for the beam of light 15 central axis 17 to emit substantially parallel to a cleaning axis 44 of the handle 1, provided that the beam angle θ is broad enough to remain in the view of an operator in ordinary cleaning positions. The view of the operator typically includes a line generally parallel to the cleaning axis 44 to a location being cleaned. The angle between the view 250 of the operator to the location being cleaned and the cleaning axis 44 will vary as the operator moves about during cleaning. In the preferred embodiment the central axis 17 of the beam of light 15 is angled vertically away from the cleaning axis 44 at an angle of approximately 5 degrees. Suitable LED lamps include Kingbrite of City of Industry, Calif. part no. KM2520A01SGC (green) and KM2520A01SRC003 (red) with a beam angle of approximately 20 degrees and an intensity of approximately 100 mcd in the configuration of the handle 1. Again, the particular angle between the cleaning axis 44 and the central axis 17, and the particular beam angle θ, chosen will depend on the particular configuration for the handle 1. In addition to allowing clearance of other components of the handle 1 (such as switch 5) and a hand of an operator 19, a central axis 17 with a slight upward angle from the cleaning axis 44 may align the central axis more closely with an eye of a typical operator 19 using the handle 1 in an ordinary cleaning position.

The cleaning axis 44 is a line from the distal end 11*a* to a location 12*c* that is currently being cleaned. The cleaning axis 44 is typically perpendicular to the distal end 11*a* of the handle 1. Typically, the distal end 11*a* has a straight portion 45 for receiving attachments, such as those described previously. This straight portion typically defines the cleaning axis 44 of the handle 1. Similarly, it has been found that acceptable for the beam of light 31 central axis 34 to emit substantially parallel to the cleaning axis 44. In the preferred embodiment the central axis 34 is vertically angled toward the cleaning axis 44 at an angle of approximately 5 degrees.

Accordingly, in the handle 1 the indicators 13 are surface mounted to the printed circuit board 35. The printed circuit board 35 is mounted generally perpendicular to the cleaning axis 44, offset by approximately 5 degrees vertically in the preferred embodiment. Similarly, in the handle 1 the lamps 25 are surface mounted to the printed circuit board 37. The printed circuit board 37 is mounted generally perpendicular to the cleaning axis 44, offset by approximately 5 degrees vertically in the preferred embodiment. Thus, the indicators 13 and the lamps 25 are mounted such that their central axes 17, 34 are substantially parallel with one another; although, the respective beams of light 15, 31 emit in opposite directions. The indicators 13 and the lamps 25 are generally in line with one another, save and except for design limitations, such as, for example, a required distance between respective indicators 13 to allow them to be physically distinguished.

The aperture 23 is covered by a protective transparent lens 47 to prevent damage to the indicators 13 and other components of the handle 1. The aperture 23 is curved inwardly for aesthetic appeal and also to provide a visual indication of the location of the switch 5. Similarly, the aperture 29 is covered by a protective lens 49. The lens 49 can be transparent, or it may be translucent to diffuse the beam of light 31 and to hide internal components. The lens 49 may have other optical qualities dependent on the characteristics desired for a given application. The lens 49 is curved outwardly to provide a smooth external surface for the illumination housing section 27.

The housing 2 also contains a microphone 100 that rests against a section 102 of the conduit 9 that is impacted by particles in the conduit 9 when in use. Typically the section 102 is an outside of a bend in the conduit 9 that forces the particles against the conduit 9. Preferably the conduit 9 made of a material that transmits sound well, such as the chromed metal typically used in "metal wands". The microphone 100 is connected to the control circuit and transmits sounds caused by particles colliding with the conduit 9 to the control circuit for use in controlling the handle 1 and, possibly, the cleaning system of which it is a part. The microphone 100 acts as a particle sensor. In the preferred embodiment, one of the indicators 13*c* illuminates when particles are sensed, and indicator 13*a* illuminates when particles are not sensed. This provides a visual indication to the operator 19 of particles at the location 12*c* being cleaned. Among other things, the operator 19 may use this information to go back over that location until no further particles are sensed, or as a prompt to consider why particles are being found in a particular location.

The microphone 100 is held against the conduit 9 using a spring mechanism 104. In the handle 1, the spring mechanism 104 is a plastic strip 106 that is curved and biased toward the conduit 9 up against the microphone 100. The microphone 100 is held laterally by four fixed plastic strips 108*a*, 108*b*, 108*c* (the fourth strip is not shown in FIG. 6) that allow the microphone 100 to slide upwardly against the spring mechanism 104, or for removal for replacement or repair. The strip 106 extends downwardly from the strip 108*a*. In the preferred embodiment the microphone 100 is in the form of a cylinder enclosed in rubber. The rubber assists in dampening vibrations at the microphone 100. Wires, not shown, extend from the top 109 of the microphone 100. The spring mechanism 104 is located to avoid the wires on the top 109 of the microphone 100. There are many other configurations of microphone that may be used in the handle 1, with or without the particular sprig mechanism described herein. Other spring mechanisms could be used to bias the microphone 100 against the conduit 9.

The indicator housing section 21 and the illuminator housing section 27 can be integrated with one another, as in the indicator illuminator housing section 33. The indicator illuminator housing section 33 may be integrated with the remainder of the housing 2. In this case, the housing 2 would typically be provided as two halves along the cross-section line shown in FIG. 6. This is commonly referred to as a "clamshell" configuration.

Alternatively, the illuminator indicator housing section 33 could be provided as a separate unit 109 that is mounted to the remainder of the housing 2. This is particularly advantageous for retrofit applications to an existing handle. This is the configuration shown in the FIGS. for handle 1. The illuminator indicator housing section 33 fits into an existing control opening 110 in the housing 2, covering the opening 110. The section 33 has a flange, not evident in FIG. 6, that fit beneath an outer shell 112 of housing 2 and rests on ribs 114 extending from the interior of the shell 112. For assembly, the unit 109 is placed in one "clamshell" half 116 and another clamshell half, not shown in FIG. 6, is mounted over the unit 109 to the clamshell half 116. This fastens the unit 109 to the remainder of the housing 2, and provides a simple way to removably retain the illuminator indicator housing section 33 against the remainder of the housing 2. The microphone 100 and related components, control circuit and wiring are mounted in the unit 109 and clamshell half 116 before the second clamshell half is assembled. The clamshell halves are generally mirrors of one another, and the unit 109 is generally symmetrical about the cross-section line of FIG. 6.

For ease of manufacture and assembly, the unit 109 is made from two pieces of moulded plastic: a top portion 118 and a bottom portion 120. The other components of the unit 109, including, for example, switch 5, boards 35, 37 and lenses 47, 49 fit into or between the top portion 118 and bottom portion 120. The top portion 118 is held to the shell 112 by the bottom portion 120 at raised flange 122 of bottom portion 120 in the front and at lowered flange 124 of top portion 118 in the rear. The unit 109 is assembled prior to insertion in the clamshell half 116.

Alternatively, the unit 109 could be snap fitted into the opening 110 after the clamshell halves are mated. Any necessary wiring would need to be connected before the clamshell halves are mated, or be brought out of the opening for connection to the unit 109. The unit could be retained in the opening using, for example, resilient tabs. Alternatively, the unit 109 can be mounted is screws or other such fastening means.

Referring to FIGS. 7-14, cleaner handles can come in many different configurations. Examples of embodiments utilizing various principles as described herein are shown. It is to be understood that these are examples embodiments only and are not intended as a complete review of all possible embodiments. It will be evident to those skilled in the art based upon the principles described herein that many more embodiments are possible. In these alternate embodiments like reference numerals will be used for like components and the description will not be repeated. The components of the handle 1 can be used in the other embodiments as desired for the particular embodiment.

Figure 7:
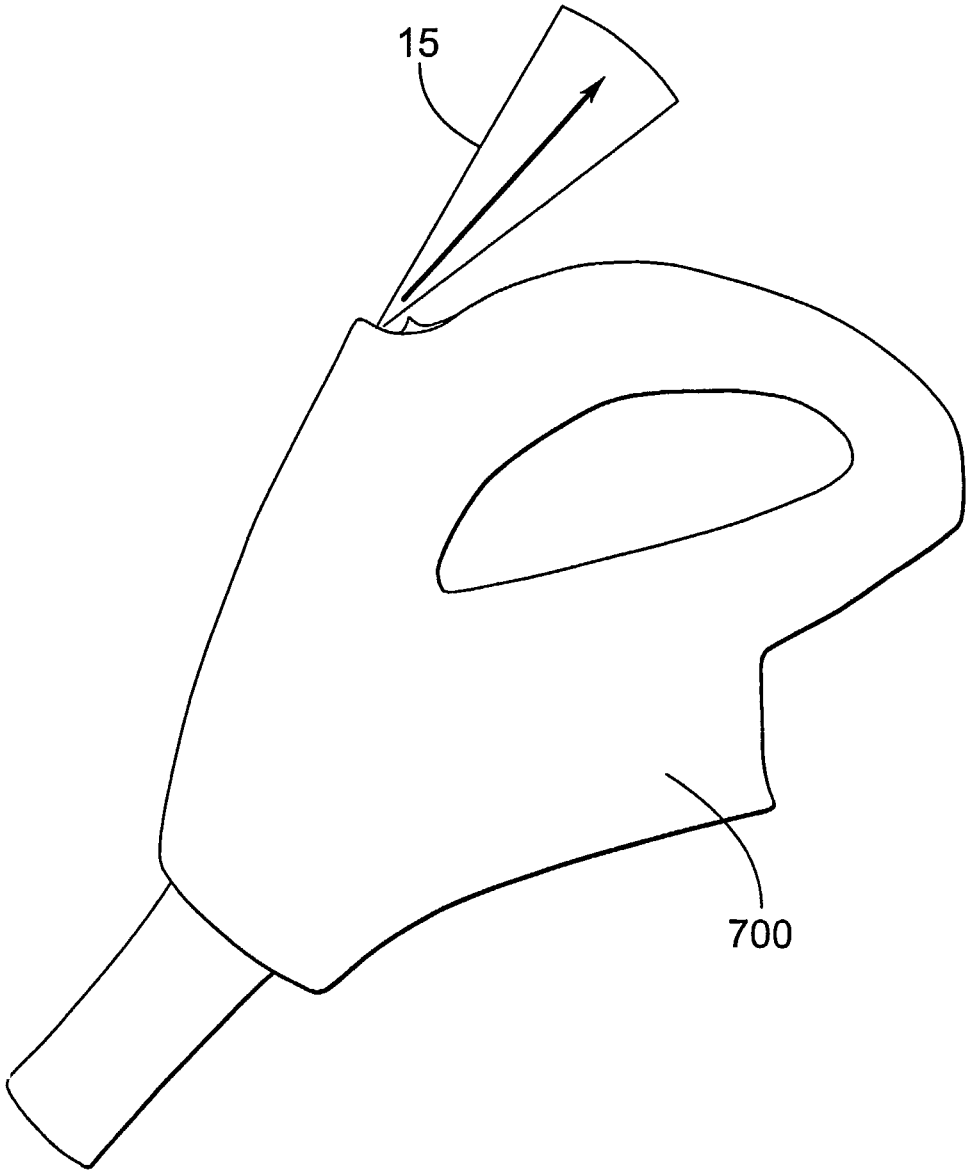
FIGS. 7-12 are side views of alternate embodiments of a handle in accordance with an embodiment of the present invention.

Referring to FIG. 7, a hose handle 700 has one or more indicators that each emit a beam of light 15 to an operator. The handle 700 has a more rounded design than that of the handle 1. The handle 100 does not have a light for illumination of a location to be cleaned.

Figure 8:
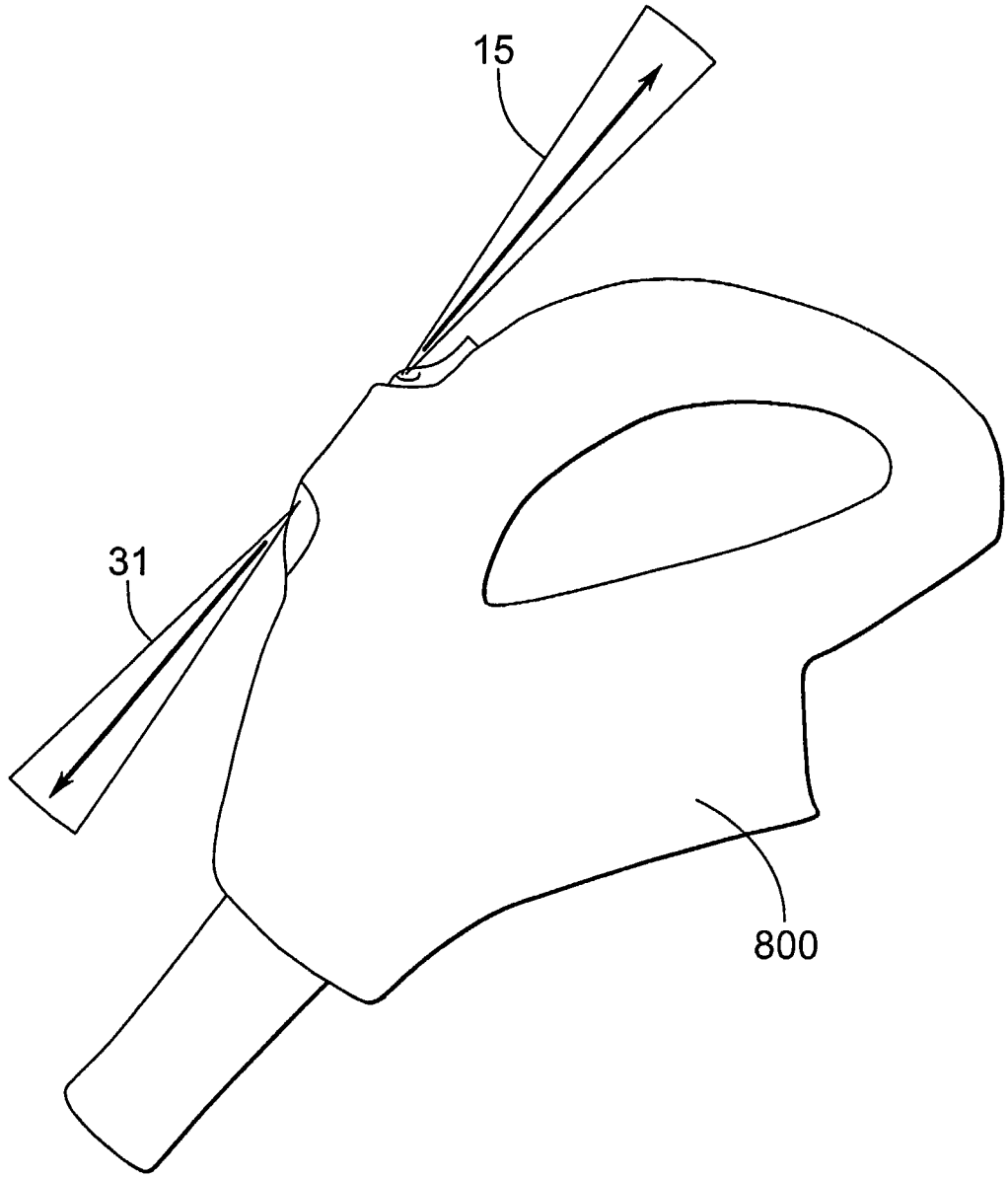

Referring to FIG. 8, hose handle 800 is similar to hose handle 700, except that the handle 800 has a light 25 that emits a beam 31 to a location to be cleaned.

Figure 9:
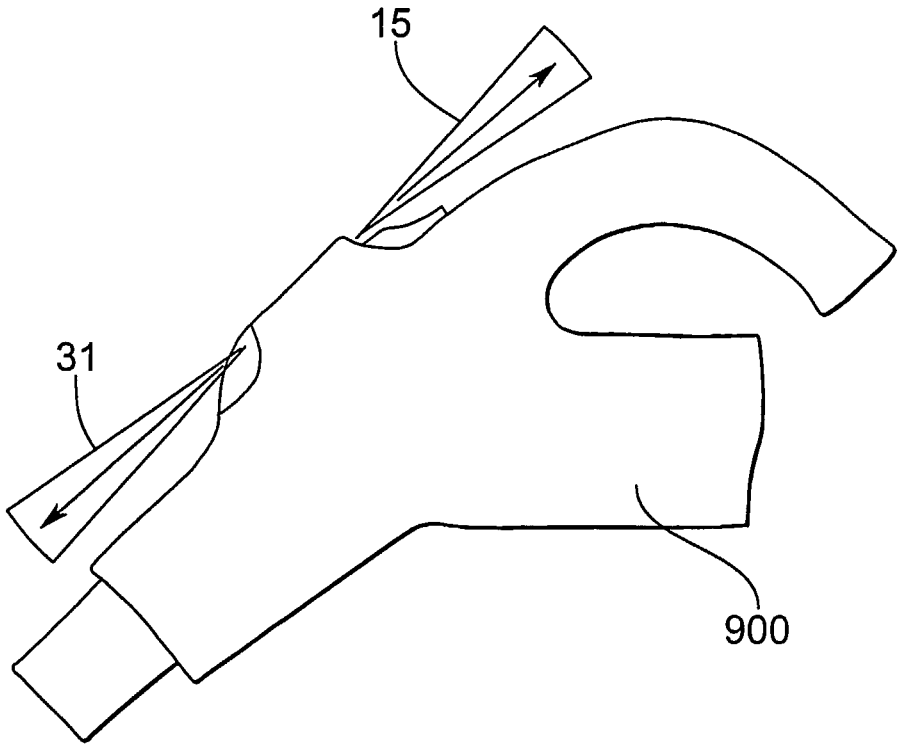

Referring to FIG. 9, a hose handle 900 has an open handle configuration. The handle 900 has one or more indicators that each emit a beam of light 15 to an operator, and a light 25 that emits a beam 31 to a location to be cleaned.

Figure 10:
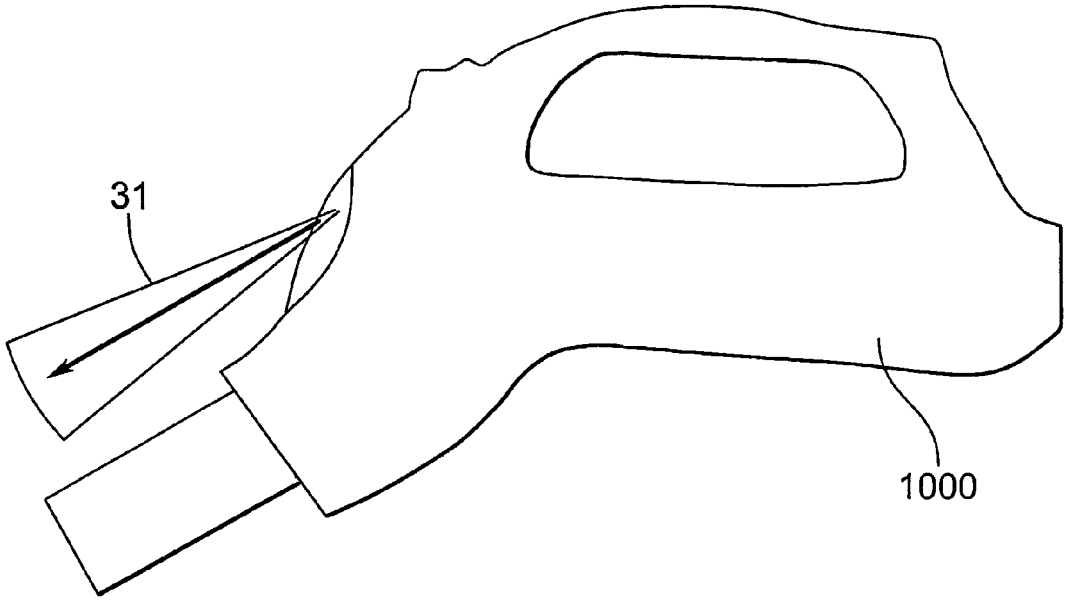

Referring to FIG. 10, a hose handle 1000 has a less-rounded closed configuration. The handle 1000 also has a light that emits a beam of light 31 to a location to be cleaned.

Figure 11:
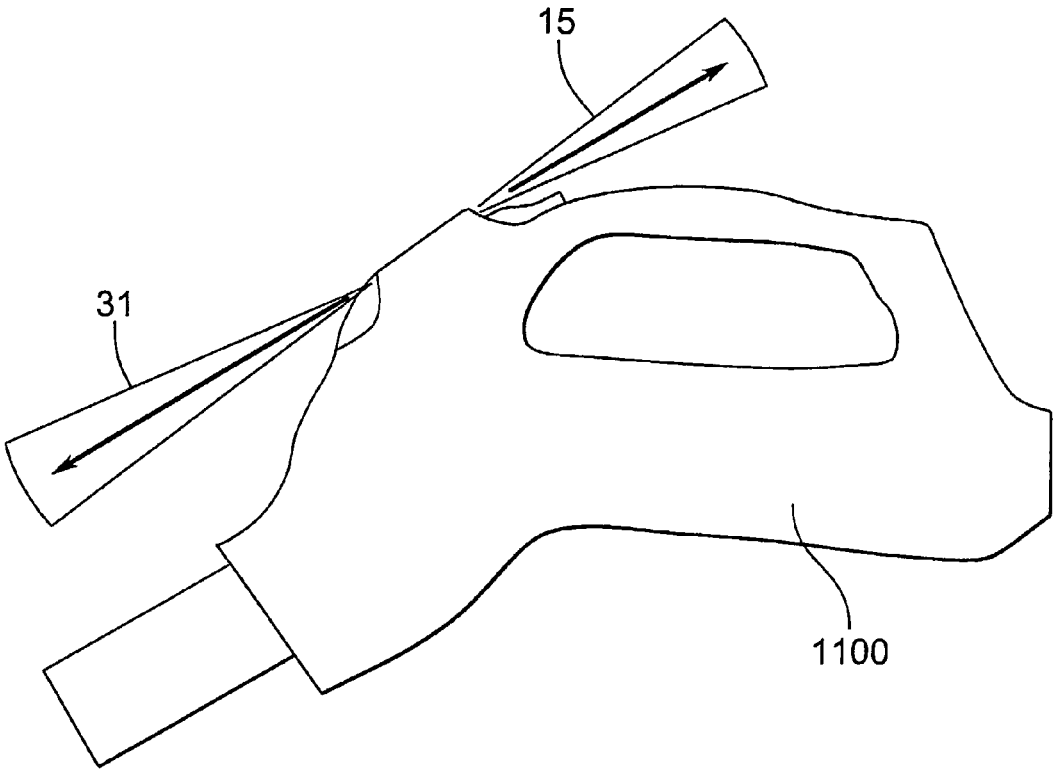

Referring to FIG. 11, a hose handle 1100 is similar to handle 1000, except that the handle 1100 also has indicators that emit beams of light 15 to an operator.

Figure 12:
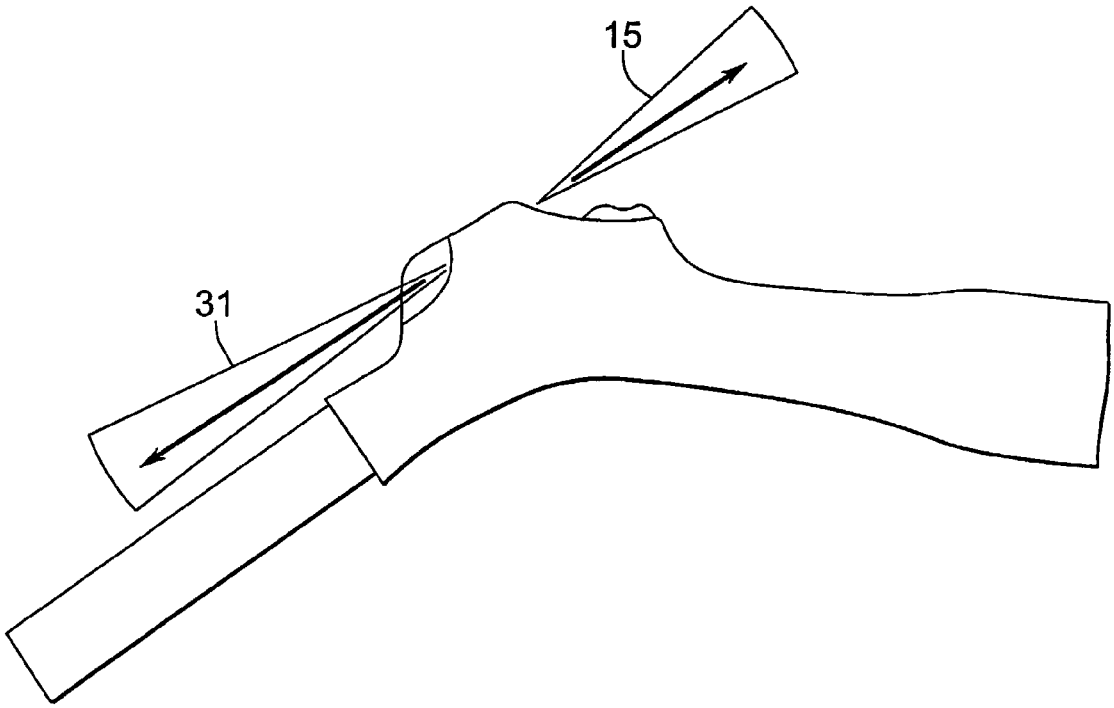

Referring to FIG. 12, a hose handle 1200 has a pistol configuration. The handle 1200 has indicators that emit a beam of light 15 to an operator, and a beam of light 31 to a location to be cleaned.

Figure 13:
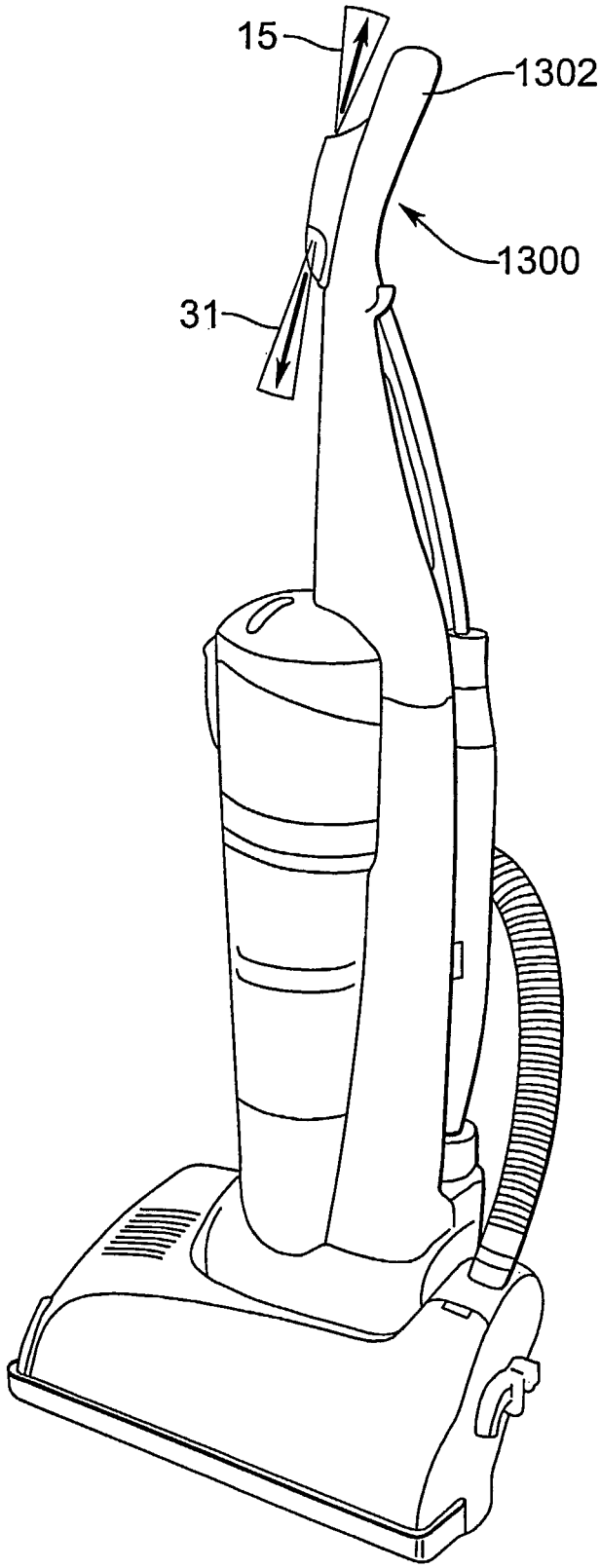
FIG. 13 is a perspective view of an upright vacuum cleaner utilizing a handle in accordance with an embodiment of the present invention.

Referring to FIG. 13, an upright vacuum cleaner 1300 has a handle 1302 that has indicators that emit a beam of light 15 to an operator, and a beam of light 31 to a location to be cleaned.

Figure 14:
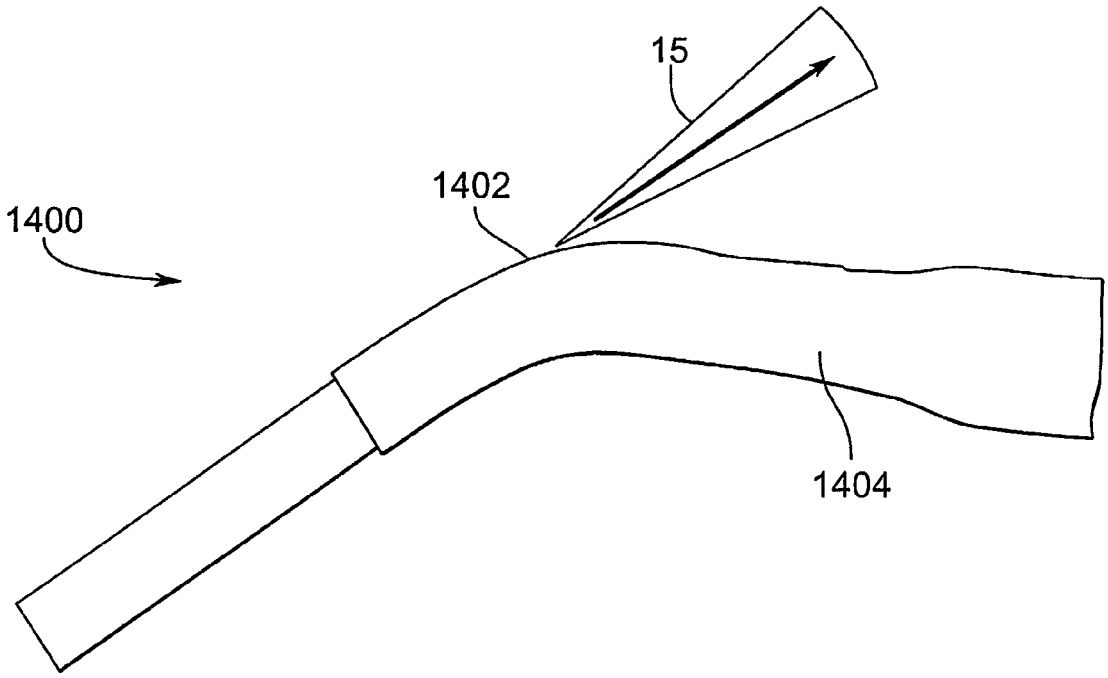
FIG. 14 is a side view of an alternate embodiment of a handle in accordance with an embodiment of the present invention.

Referring to FIG. 14, although it is preferable to have a raised housing section 21, a handle 1400 has an indicator that is placed at an angle to surface 1402 of handle housing 1404. The angle is selected to direct a beam of light 15 from the indicator such that the beam of light falls within the view of the operator when using the handle in an ordinary vacuuming position. The orientation of the beam of light may be parallel to a cleaning axis of the handle 1400, or it may be oriented upwardly to avoid obstructions, such as a hand of the operator on the handle.

The beam of light 15 could be emitted perpendicular to the surface of a handle, provided that the surface was oriented to allow beam of light 15 to be in view of the operator when using the handle in an ordinary vacuuming position.

Figure 15:
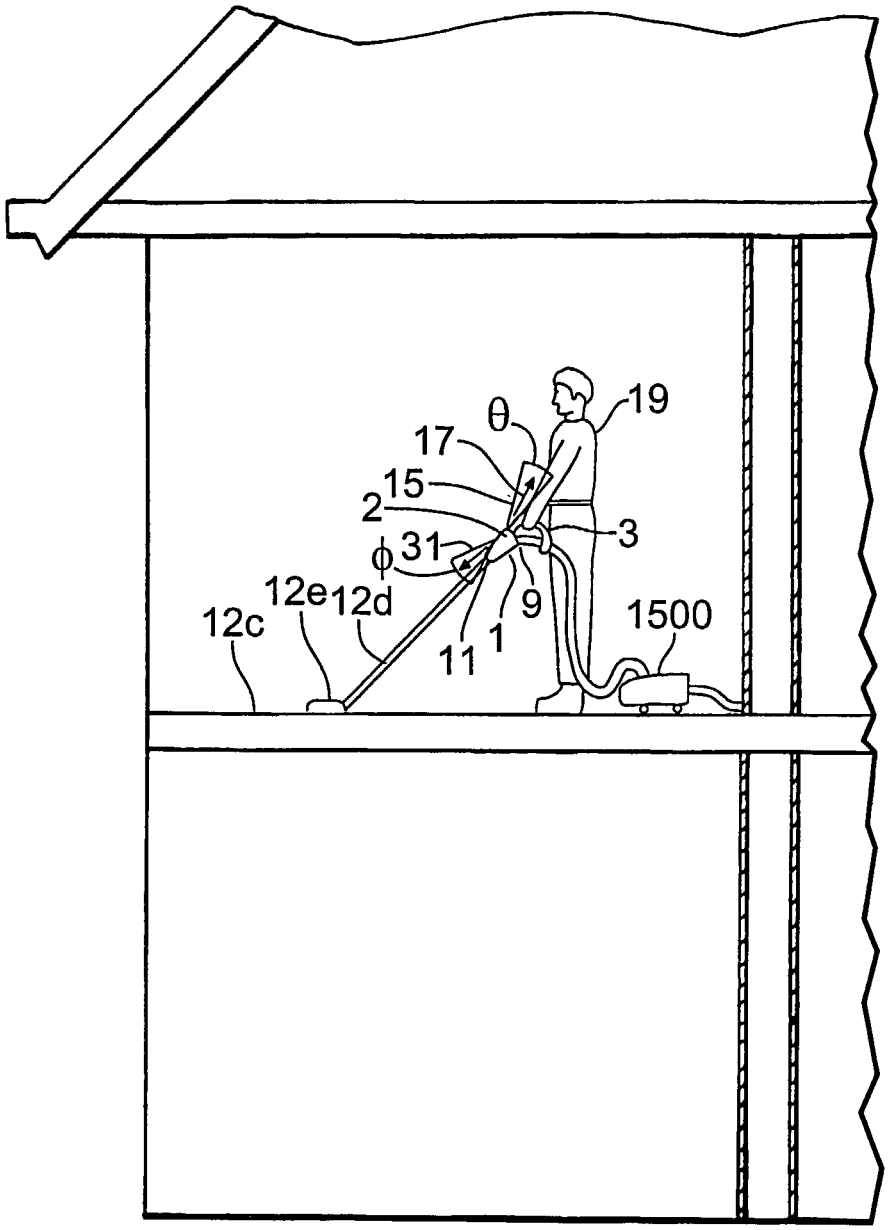
FIG. 15 is a partial cross-section of a building containing a central vacuum cleaner utilizing the handle of FIG. 1.

Referring to FIG. 15, a handle 1 is used in association with a canister vacuum cleaner unit 1500.

Clearly, many different embodiments based on the principles described herein are possible. Beams of light can be emitted from a lamp at a cleaner handle to illuminate a location to be cleaned. Beams of light can be directed from an indicator of a cleaner handle to an operator and be viewable when the handle is used in an ordinary cleaning position. The illumination lamp and the indicator can be provided separately, or provided on the same handle. The beams of light can have a limited viewing angle.

It will be understood by those skilled in the art that this description is made with reference to the preferred embodiment and that it is possible to make other embodiments employing the principles of the invention which fall within its spirit and scope as defined by the following claims.

We claim:

1. A cleaner handle for use on a cleaner, the handle comprising:

a) a grasping section for manipulating the cleaner, b) an indicator housing, c) at least one indicator within the indicator housing, the at least one indicator having a limited viewing angle and a central axis, wherein the central axis is directed over and across the grasping section, wherein the central axis of the indicator is generally parallel with a cleaning axis of the handle, and wherein the handle comprises a handle distal end where particles are to be drawn into the handle, and a straight portion at the handle distal end having a longitudinal axis that is the cleaning axis.

2. The handle of claim 1, wherein the cleaner is a vacuum cleaner.

3. The handle of claim 1, wherein the cleaner is a central vacuum cleaner.

4. The handle of claim 1, wherein the cleaner is a canister vacuum cleaner.

5. The handle of claim 1, wherein the cleaner is an upright vacuum cleaner.

6. The handle of claim 1, wherein the indicator is an LED lamp.

7. The handle of claim 1, wherein the indicator is an LCD display.

8. The handle of claim 1, further comprising:

a) an illuminator housing, and b) a light within the illuminator housing, the light for illuminating with visible light an area that is being cleaned with the cleaner, wherein a central beam axis of the light is generally parallel with the cleaning axis of the handle.

9. The handle of claim 8 wherein the light is one or more LED lamps.

10. The handle of claim 9 wherein each LED lamp has a beam angle of approximately 12°.

11. The handle of claim 1, wherein the indicator housing section comprises: an aperture, and the indicator is viewable through the aperture.

12. The handle of claim 11, wherein the aperture is raised such that the indicator is viewable over a hand of an operator that is grasping the grasping section.

13. The handle of claim 12, further comprising: a particle sensor for sensing particles flowing through the handle during operation of the cleaner.

14. The handle of claim 13, wherein the particle sensor comprises: a microphone for sensing sound emitted when particles collide with a conduit in the handle as the particles flow through the cleaner.

15. The handle of claim 14, wherein the conduit is metal.

16. The handle of claim 14, wherein the microphone is held against the conduit by a spring mechanism.

17. The handle of claim 16, wherein the spring mechanism is a biased curved plastic strip.

18. The handle of claim 1 wherein the indicator viewing angle is approximately 20°.

19. A cleaner handle for use on a cleaner, the handle comprising:

a) a grasping section for manipulating the cleaner, b) an indicator housing, c) at least one indicator within the indicator housing, the at least one indicator having a limited viewing angle and a central axis, wherein the central axis is directed over and across the grasping section, wherein the central axis of the indicator is directed approximately 5 degrees vertically above a cleaning axis of the handle, wherein the handle comprises a handle distal end where particles are to be drawn into the handle, and a straight portion at the handle distal end having a longitudinal axis that is the cleaning axis.

20. The handle of claim 19, further comprising:

a) an illuminator housing, and b) a light within the illuminator housing, the light for illuminating with visible light an area that is being cleaned with the cleaner, wherein a central beam axis of the light is directed within approximately 5 degrees vertically of the cleaning axis of the handle.

21. A cleaner handle for use on a cleaner, the handle comprising:

a) a grasping section for manipulating the cleaner, b) an indicator housing, c) at least one indicator within the indicator housing, the at least one indicator having a limited viewing angle and a central axis, wherein the central axis is directed over and across the grasping section, wherein the central axis of the indicator is directed at least 5 degrees vertically above a cleaning axis of the handle, and wherein the handle comprises a handle distal end where particles are to be drawn into the handle, and a straight portion at the handle distal end having a longitudinal axis that is the cleaning axis.

22. The handle of claim 21, wherein the cleaner is a vacuum cleaner.

23. The handle of claim 21, wherein the cleaner is a central vacuum cleaner.

24. The handle of claim 21, wherein the cleaner is a canister vacuum cleaner.

25. The handle of claim 21, wherein the cleaner is an upright vacuum cleaner.

26. The handle of claim 21, wherein the indicator is an LED lamp.

27. The handle of claim 21, wherein the indicator is an LCD display.

28. The handle of claim 21, further comprising:

a) an illuminator housing, and b) a light within the illuminator housing, the light for illuminating with visible light an area that is being cleaned with the cleaner, wherein a central beam axis of the light is generally parallel with the cleaning axis of the handle.

29. The handle of claim 21, wherein the indicator housing section comprises: an aperture, and the indicator is viewable through the aperture.

30. The handle of claim 29, wherein the aperture is raised such that the indicator is viewable over a hand of an operator that is grasping the grasping section.

31. A cleaner handle for use on a cleaner, the handle comprising:

a) a grasping section for manipulating the cleaner, b) an indicator housing section, c) at least one indicator within the indicator housing section, the at least one indicator including a lamp for emitting a visible beam of light from the indicator housing with a limited beam angle and a central beam axis, wherein the central beam axis is directed over and across the grasping section, wherein the central beam axis of the indicator is generally parallel with a cleaning axis of the handle, and wherein the handle comprises a handle distal end where particles are to be drawn into the handle, and a straight portion at the handle distal end having a longitudinal axis that is the cleaning axis.

32. The handle of claim 31, wherein the indicator housing section comprises: an aperture, and the beam of light emits from the aperture.

33. The handle of claim 32, wherein the aperture is raised such that the indicator beam of light emits over a hand of an operator that is grasping the grasping section.

34. A cleaner handle for use on a cleaner, the handle comprising:

a) a grasping section for manipulating the cleaner, b) an indicator housing section, c) at least one indicator within the indicator housing section, the at least one indicator including a lamp for emitting a visible beam of light from the indicator housing with a limited beam angle and a central beam axis, wherein the central beam axis is directed over and across the grasping section, wherein the central beam axis of the indicator is directed approximately 5 degrees vertically above a cleaning axis of the handle, and wherein the handle comprises a handle distal end where particles are to be drawn into the handle, and a straight portion at the handle distal end having a longitudinal axis that is the cleaning axis.

35. A cleaner handle for use on a cleaner, the handle comprising:

a) a grasping section for manipulating the cleaner, b) an indicator housing section, c) at least one indicator within the indicator housing section, the at least one indicator including a lamp for emitting a visible beam of light from the indicator housing with a limited beam angle and a central beam axis, wherein the central beam axis is directed over and across the grasping section, wherein the central beam axis of the indicator is directed at least 5 degrees vertically above a cleaning axis of the handle, and wherein the handle comprises a handle distal end where particles are to be drawn into the handle, and a straight portion at the handle distal end having a longitudinal axis that is the cleaning axis.

* * * * *